US009410756B2

(12) United States Patent
Gardner et al.

(10) Patent No.: US 9,410,756 B2
(45) Date of Patent: Aug. 9, 2016

(54) GAS FLOW VOLUME CONTROL APPARATUS

(71) Applicants: Todd Conrad Gardner, Winter Garden, FL (US); Wyndell Todd Kern, Winter Garden, FL (US)

(72) Inventors: Todd Conrad Gardner, Winter Garden, FL (US); Wyndell Todd Kern, Winter Garden, FL (US)

( * ) Notice: Subject to any disclaimer, the term of this patent is extended or adjusted under 35 U.S.C. 154(b) by 0 days.

(21) Appl. No.: 14/643,948

(22) Filed: Mar. 10, 2015

(65) Prior Publication Data

US 2015/0253091 A1 Sep. 10, 2015

Related U.S. Application Data

(60) Provisional application No. 61/950,295, filed on Mar. 10, 2014.

(51) Int. Cl.
*F41A 5/20* (2006.01)
*F41A 5/28* (2006.01)

(52) U.S. Cl.
CPC .... *F41A 5/28* (2013.01); *F41A 5/20* (2013.01)

(58) Field of Classification Search
CPC ..... F41A 5/20; F41A 5/26; F41A 5/28; F41A 5/18; F41C 23/16
USPC ..... 89/193, 129.01, 191.01, 191.02, 192; 124/56, 70–76
See application file for complete search history.

(56) References Cited

U.S. PATENT DOCUMENTS 3,527,194 A * 9/1970 Desrochers ..... F41B 11/62 124/37
RE27,568 E * 1/1973 Vadas et al. ..... F41B 11/62 124/37
5,768,818 A * 6/1998 Rustick ..... F41A 5/26 42/75.02
5,945,626 A * 8/1999 Robbins ..... F41A 5/26 42/111
7,610,844 B2 * 11/2009 Kuczynko ..... F41A 5/28 89/193
7,856,917 B2 * 12/2010 Noveske ..... F41A 5/28 89/193
8,596,185 B1 * 12/2013 Soong ..... F41A 5/28 89/193
8,667,882 B1 * 3/2014 Larson ..... F41A 3/66 89/140
8,960,069 B1 * 2/2015 Soong ..... F41A 5/28 89/193
D742,990 S * 11/2015 Huang ..... D22/108
9,335,106 B1 * 5/2016 Simon ..... F41A 5/26
2010/0282066 A1 * 11/2010 Tankersley ..... F41A 5/26 89/193
2011/0179945 A1 * 7/2011 Clark ..... F41A 5/18 89/193
2011/0271827 A1 * 11/2011 Larson ..... F41A 5/28 89/193
2012/0167757 A1 * 7/2012 Gomez ..... F41A 5/28 89/193
2013/0098235 A1 * 4/2013 Reinken ..... F41A 5/28 89/193
2014/0076149 A1 * 3/2014 Adams ..... F41A 5/28 89/192
2014/0076150 A1 * 3/2014 Brinkmeyer ..... F41A 5/28 89/193
2014/0224114 A1 * 8/2014 Faxon ..... F41A 15/14 89/193
2015/0226503 A1 * 8/2015 Yollu ..... F41A 5/28 89/193
2016/0047614 A1 * 2/2016 Larson, Jr. ..... F41A 5/28 89/191.01

* cited by examiner

*Primary Examiner* — Michael David

(57) ABSTRACT

A gas flow volume control apparatus includes an adjustable gas block and a securing member as the securing member fixes the adjustable gas block onto a barrel of a firearm. The adjustable gas block is in fluid communication with the barrel so that generated gas of a propelling bullet can be recycled within a gas-operated reloading system. The generated gas is rerouted from the barrel to the gas-operated reloading system through a gas flow channel and a gas-tube channel of the adjustable gas block. An adjustment channel of the adjustable gas block also allows a user to control the rerouted amount of generated gas in order to optimize the performance of the firearm.

8 Claims, 8 Drawing Sheets

GAS FLOW VOLUME CONTROL APPARATUS

The current application claims a priority to the U.S. Provisional Patent application No. 61/950,295 filed on Mar. 10, 2014.

FIELD OF THE INVENTION

The present invention relates generally to attachments for firearms which are meant to alter or redirect the gas flow produced when the firearm is discharged. More specifically, the present invention is a gas flow volume control device which is intended to be attached to a firearm and to allow for variable harvesting of the excess gasses produced by its discharge. Harvested gas flow is redirected and can be utilized to chamber a new round and rearm the firing mechanism, thus readying the firearm to discharge again.

BACKGROUND OF THE INVENTION

Firearms are common in many parts of the world, and have been in use for centuries. Firearms are useful in both civilian and military applications, as they excel at hitting targets at long range, often with lethal results. In the case of most firearms, it is this lethality that makes them so useful. In civilian applications firearms are exceedingly effective for hunting game. Hunting is still a major source of protein for many cultures around the world, and firearms are very useful for such purposes. In military applications, firearms allow for the neutralization of hostile targets at long range. These uses have ensures that firearms remain an extremely common tool which can be found throughout human society in both civilian and military applications.

Although the long exposure and large adoption of firearms has resulted in many related technologies being developed, there still remain a large number of improvements that can be made to certain areas of firearm technology. On such area is the concept of gas-operated reloading. Gas-operated reloading allows for the creation of self-loading firearms which use energy created by firing a bullet chamber a new round and therefore ready the firearm to discharge again.

There are many designs for gas-operated reloading systems, and they all have varying degrees of complexity and functionality added to the firearm. Some gas-operating systems are fixed, in that the amount of gas that is redirected back into the gun cannot be modified; such systems are often designed into the firearm and cannot be easily removed or modified without compromising the functionality of the firearm. Gas-operated reloading systems can create difficulties when certain accessories are added to a firearm, especially accessories that alter the firing characteristics of the firearm. For example, if a suppressor is attached to a rifle, the ideal amount of redirected gas is altered as compared to the same firearm without a suppressor. Some systems allow for a level of control of the impedance of gas flow, but suffer from undesired positional adjustments in use and difficult operation of the adjustment mechanisms.

It is therefore an object of the present invention to provide a user adjustable gas-flow volume control for a gas-operated reloading system. It is a further object of the present invention to provide stable and discrete levels of gas flow impedance by providing varying levels of discrete variation. It is a further object still of the present invention to be easily operated in confined spaces with minimal tool usage.

DETAIL DESCRIPTIONS OF THE INVENTION

All illustrations of the drawings are for the purpose of describing selected versions of the present invention and are not intended to limit the scope of the present invention.

Figure 1:
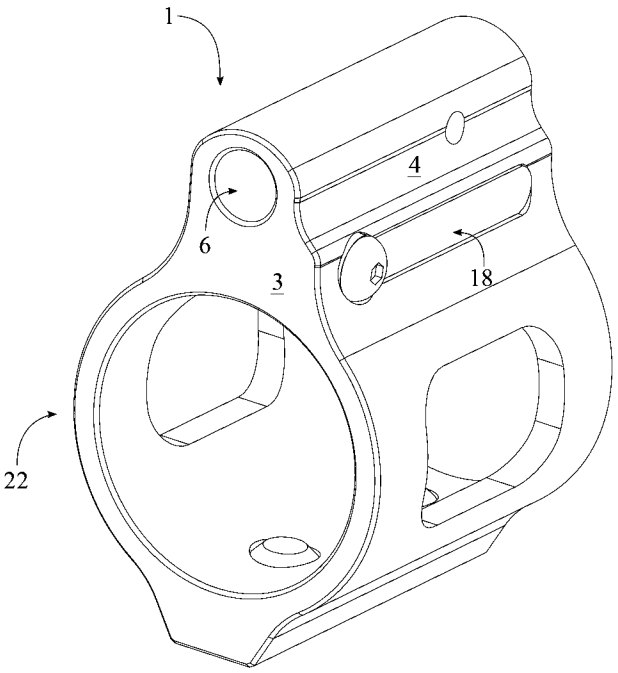
FIG. 1 is a perspective view of the present invention illustrating the rear surface of the present invention.

In the field of firearms, it is common for the gas generated from firing a bullet to be rerouted through a gas block and a gas tube, where the rerouted gas is recycled within a gas-operated reloading mechanism. Once the gas is rerouted through the gas block and gas tube, the rerouted gas is able to load the chamber with another round so that the firearm is prepared to fire once again. The present invention is a gas flow volume control apparatus as the present invention is able to control amount of rerouted gas that is recycled through a gas-operated reloading mechanism. In reference to FIG. 1 and FIG. 2, the present invention comprises an adjustable gas block 1 and a securing member 22 as the adjustable gas block 1 is adjacently connected atop the securing member 22. The present invention can be retrofitted or pre-manufactured with different firearms that utilize the gas-operated reloading mechanism.

Figure 3:
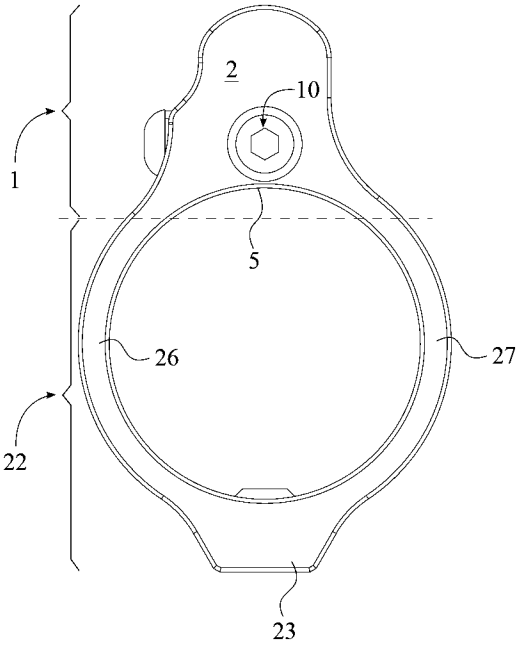
FIG. 3 is a front view of the present invention.

The adjustable gas block 1 is designed to receive the barrel of the firearm while the securing member 22 is designed to secure the adjustable gas block 1 onto the firearm. The securing member 22 is a generally cylindrical in shape and comprises a connecter base 23, a first lateral wall 26, and a second lateral wall 27. In reference to FIG. 3, the connecter base 23 is diametrically opposed of the adjustable gas block 1 while the first lateral wall 26 and the second lateral wall 27 are connected in between the connecter base 23 and the adjustable gas block 1 opposite of each other. The connecter base 23 secures the present invention onto the firearm while the first lateral wall 26 and the second lateral wall 27 function as the supporting members. More specifically, the connecter base 23 comprises at least one mounting hole 24 and at least one fastener screw 25 as the at least one mounting hole 24 opens into the present invention as observed in FIG. 5 and FIG. 6, thereby allowing the at least one fastener screw 25 to be engaged within the at least one mounting hole 24. As a result, the present invention can be fixed at some point along the barrel of the firearm. The at least one mounting hole 24 is preferably oriented perpendicular to a central axis of the present invention so that the at least one fastener screw 25 is able to securely fix the adjustable gas block 1 with the barrel of the firearm. Additionally, the first lateral wall 26 and the second lateral wall 27 each comprise a cutout that is perimetrically located within the first lateral wall 26 and the second lateral wall 27, as can be observed in FIG. 1. The cutout is intended to reduce the overall weight of the present invention, thereby minimizing the amount of weight added to a firearm when the present invention is installed. In an alternative embodiment, the securing member 22 comprises only the first lateral wall 26 and the second lateral wall 27, where the first lateral wall 26 and the second lateral wall 27 are secured together as a clamping mechanism. More specifically, the adjustable gas block 1 is securely mounted to the barrel of the firearm through the first lateral wall 26 and the second lateral wall 27 as the first lateral wall 26 and the second lateral wall 27 are clamped to each other.

The adjustable gas block 1 is in fluid communication with the gun barrel so that the generated gas, which is created behind a propelling bullet, can be harvested for the gas-operated reloading mechanism. In reference to FIG. 1-FIG. 8, the adjustable gas block 1 comprises a barrel interface surface 5, a gas-tube channel 6, a gas flow channel 8, an adjustment channel 9, an adjustment screw 10, a detent slot 15, and a leaf spring detent 18. The barrel interface surface 5 is positioned in between the first lateral wall 26 and the second lateral wall 27, and extends from a front surface 2 of the adjustable gas block 1 to a rear surface 3 of the adjustable gas block 1. The barrel interface surface 5 is formed to match with the shape of the firearm barrel so that the adjustable gas block 1 can be hermetically connected with the barrel of the firearm, optimizing the efficiency of the present invention.

Figure 2:
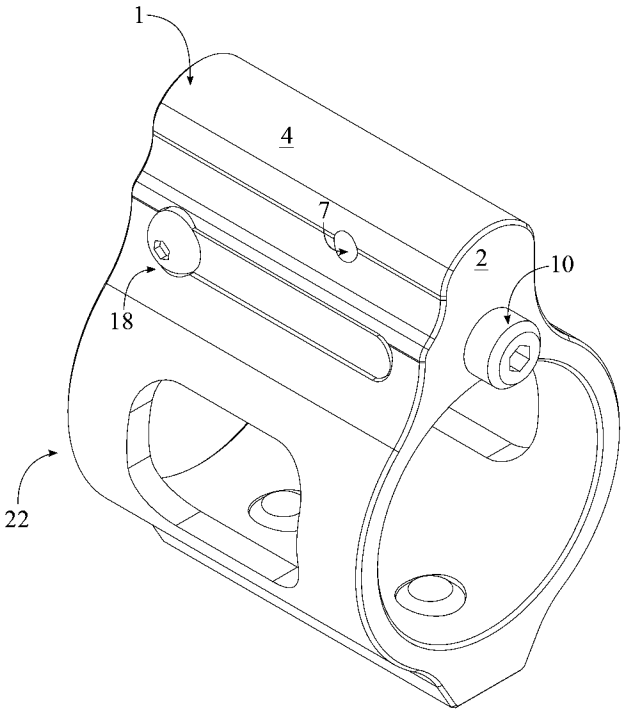
FIG. 2 is a perspective view of the present invention illustrating the front surface of the present invention.
Figure 4:
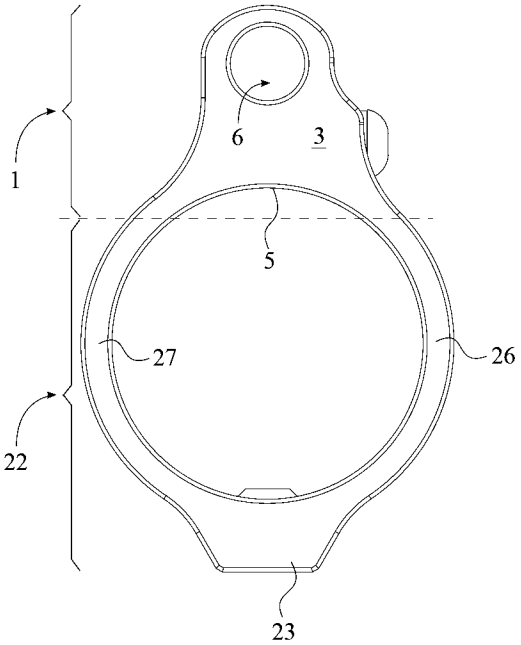
FIG. 4 is a rear view of the present invention.

The gas-tube channel 6 is designed to receive a gas tube of the firearm so that the generated gas can be rerouted back into the firearm to assist with reloading. In reference to FIG. 7, the gas-tube channel 6 is traversed into the adjustable gas block 1 from the rear surface 3 so that the gas tube can be directly place in between the present invention and the gas-operated reloading mechanism. The gas-tube channel 6 is offset from the barrel interface surface 5 and positioned parallel with the barrel interface surface 5 so that other related component of the present invention can be positioned in between the gas-tube channel 6 and the barrel interface surface 5. A tube-connecter recess 7 of the present invention is traversed through an external surface 4 of the adjustable gas block 1 and perpendicularly intersected with the gas-tube channel 6 as shown in FIG. 2 and FIG. 8. The tube-connecter recess 7 is intended to provide a means to secure the gas tube of the firearm into the gas-tube channel 6 so that the gas tube and the gas-tube channel 6 do not become separated during operation of the firearm.

Figure 7:
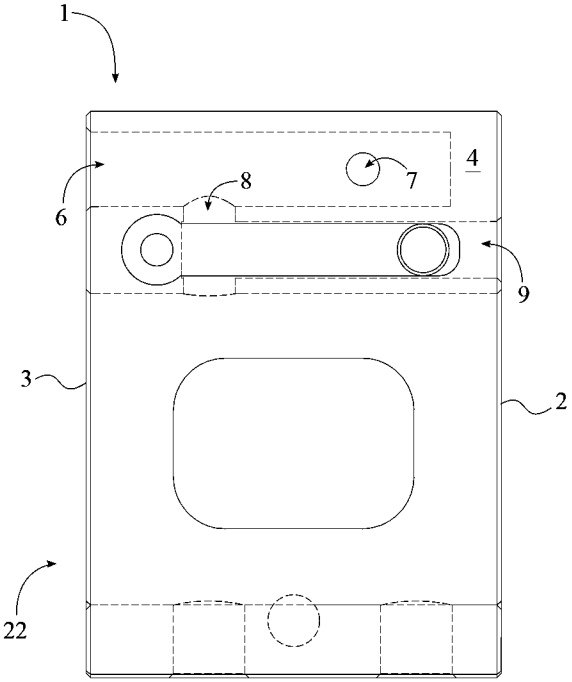
FIG. 7 is a side view of the adjustable gas block of the present invention illustrating the gas-tube channel, the adjustment channel, and the gas flow channel.
Figure 8:
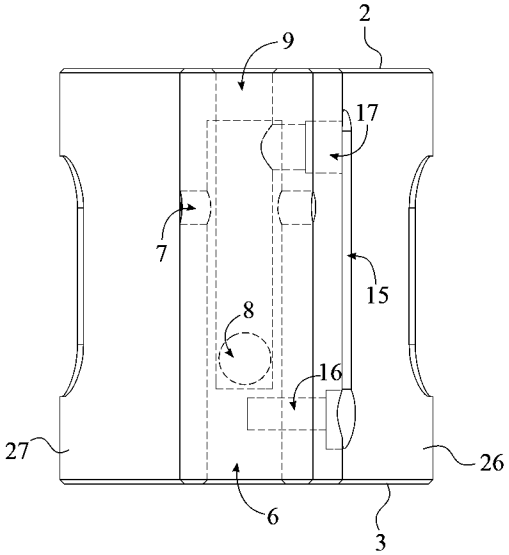
FIG. 8 is a top view of the adjustable gas block of the present invention illustrating the gas-tube channel, the adjustment channel, the gas flow channel, fastener slot, and the detent bore.

In reference to FIG. 7, the gas flow channel 8 is traversed from the barrel interface surface 5 to the gas-tube channel 6 as the gas flow channel 8 is vertically positioned between the barrel interface surface 5 and the gas-tube channel 6. The gas flow channel 8 is also in fluid communication with the gas-tube channel 6 so that the generated gas can be rerouted from the barrel of the firearm, through the gas flow channel 8, and into the gas-tube channel 6. In order to create the direct flow path for generated gas, the gas flow channel 8 is perpendicularly positioned with the gas-tube channel 6.

In reference to FIG. 7, the adjustment channel 9 and the adjustment screw 10 allow the users to control amount of generated gas discharged into the gas-tube channel 6. The adjustment channel 9 is traversed into the gas flow channel 8 from the front surface 2 through the adjustable gas block 1 so that the adjustment channel 9 is in fluid communication with the gas flow channel 8. Since the adjustment channel 9 traverses into the gas flow channel 8 from the front surface 2, a user is able to easily control amount of the generated gas through the adjustment screw 10. Additionally, the adjustment channel 9 is positioned in between the barrel interface surface 5 and the gas-tube channel 6, where the adjustment channel 9 is oriented parallel with the barrel interface surface 5 and the gas-tube channel 6.

The assembly and operation of the present invention requires the adjustment screw 10 to be engaged with the adjustment channel 9. The adjustment screw 10 is driven into and out of the adjustment channel 9 in very small increments in order to control the amount of gas redirected through the adjustable gas block 1. In the preferred embodiment of the present invention, the adjustment screw 10 is engaged within the adjustment channel 9. This engagement is accomplished by providing external threading on the adjustment screw 10 with matching internal threading on the adjustment channel 9. This type of engagement allows the adjustment screw 10 to be driven into or out of the adjustment channel 9 so that the adjustment screw 10 can move in between a fully opened configuration, a partially opened configuration, and a closed configuration of the gas flow channel 8. For example, when the adjustment screw 10 is only positioned within the adjustment channel 9, the gas flow channel 8 is considered to be in the fully opened configuration as the gas flow channel 8 is completely opened in between the barrel interface surface 5 and the gas-tube channel 6. As a result, a full complement of generated gas is able to discharge into the gas-tube channel 6 through the gas flow channel 8. When the adjustment screw 10 partially extends into the gas flow channel 8, the gas flow channel 8 is considered to be in the partially opened configuration as the gas flow channel 8 is partially opened in between the barrel interface surface 5 and the gas-tube channel 6. As a result, a limited amount of generated gas is able to discharge into the gas-tube channel 6 through the gas flow channel 8. When the adjustment screw 10 fully extends into the gas flow channel 8, the gas flow channel 8 is considered to be in the closed configuration as the gas flow channel 8 is fully closed in between the barrel interface surface 5 and the gas-tube channel 6. As a result, generated gas is not able to discharge into the gas-tube channel 6 through the gas flow channel 8. In the preferred embodiment of the present invention, the adjustment screw 10 is manipulated by means of a hex key, which engages with a screw head 11 of the adjustment screw 10 to allow a user to easily turn the adjustment screw 10. The hex key provides an advantage of increased reach, allowing a user to turn the adjustment screw 10 even if it partially obstructed or located in a confined space, where fingers and larger tools may be unable to operate. In other embodiments of the present invention it is possible to use other types of manipulation, such as using a thumb screw as the adjustment screw 10.

Figure 10:
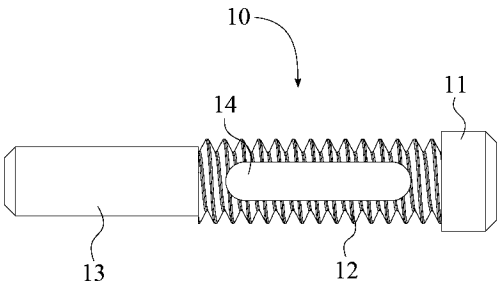
FIG. 10 is a side view of the adjustment screw.
Figure 9:
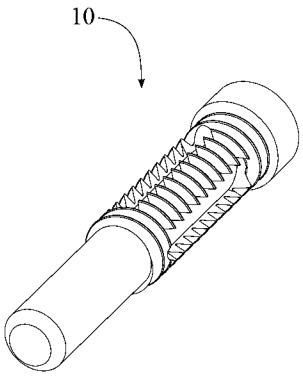
FIG. 9 is a perspective view the adjustment screw.

In reference to FIG. 9 and FIG. 10, the adjustment screw 10 comprises a threaded screw body 12, a flat screw body 13, and at least one axial groove 14 in addition to the screw head 11. The screw head 11 is concentrically connected with the threaded screw body 12, and the flat screw body 13 is concentrically connected with the threaded screw body 12 opposite of the screw head 11. The screw head 11 allows the adjustment screw 10 to be manipulated by external forces while the threaded screw body 12 and the flat screw body 13 are retained within the adjustment channel 9. The at least one axial groove 14 is radially positioned along the threaded screw body 12, allowing the adjustment screw 10 to secured in a discrete position in conjunction with the leaf spring detent 18.

In the preferred embodiment of the present invention, the at least one axial groove 14 comprises a first groove, a second groove, and a third groove as each groove is positioned along the threaded screw body 12. In relation to each other, the first groove, the second groove, and the third groove are evenly distributed around the threaded screw body 12, such that the separation angle between adjacent grooves is 120 degrees. The first groove, the second groove, and the third groove interact with a detent plunger 21 of the leaf spring detent 18, allowing the adjustment screw 10 to be secured in a discrete position. In the preferred embodiment of the present invention, the lateral movement that the adjustment screw 10 can be driven into or out of the gas flow channel 8 is 0.125 inches. The adjustment screw 10 itself is 1 inch long and has a 8/32 inch threads per inch. The grooves are each 0.250 inches in length and depth of 0.030 inches. The hex key is a 2 mm ball end. Though these dimensions are provided for the preferred embodiment, the dimensions may be altered to fit different sizes of the adjustable gas block 1 and firearms.

The detent slot 15 is traversed into one of the sides of the adjustable gas block 1 as the leaf spring detent 18 connects with the detent slot 15 and engages with the threaded screw body 12 of the adjustment screw 10. The detent slot 15 is a long rectangular shape of some length that is cut to some depth into the adjustable gas block 1 from the external surface 4 and comprises a fastener slot 16 and a detent bore 17. In reference to FIG. 6 and FIG. 8, the fastener slot 16 and the detent bore 17 are oppositely positioned of each other across the detent slot 15 as the fastener slot 16 is traversed into the adjustable gas block 1, and the detent bore 17 is perpendicularly traversed into the adjustment channel 9. The fastener slot 16 and the detent bore 17 are oriented within the detent slot 15 so that the leaf spring detent 18 is able to secure onto the adjustable gas block 1.

Figure 5:
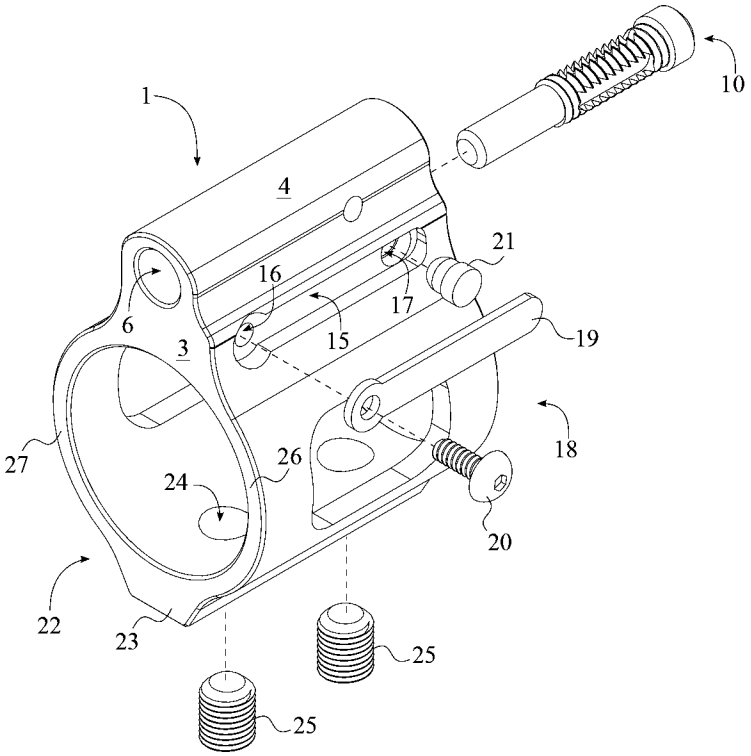
FIG. 5 is an exploded view of the present invention.
Figure 6:
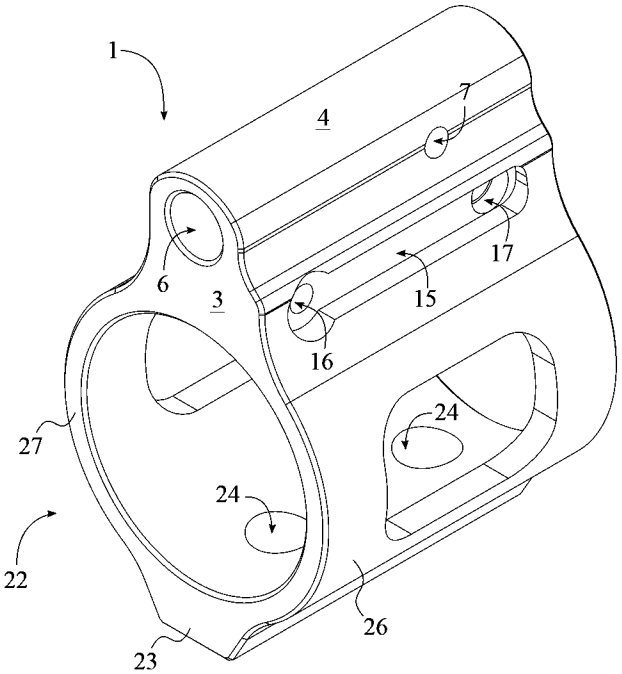
FIG. 6 is a perspective view of the adjustable gas block of the present invention.

In reference to FIG. 5, the leaf spring detent 18 comprises a leaf spring 19 and a set screw 20 in addition to the detent plunger 21. The leaf spring 19 is positioned within the detent slot 15 so that the set screw 20 is able to traverse through the leaf spring 19 and securely engages with the fastener slot 16. The assembly and operation of the present invention requires not only the adjustment screw 10 to be engaged with the adjustment channel 9 but also the detent plunger 21 to be engaged with the detent bore 17. The detent plunger 21 is concentrically positioned within the detent bore 17 and engaged with at least one axial groove 14 of the adjustment screw 10 so that the leaf spring 19 is able retain the detent plunger 21 within the detent bore 17. Since the detent plunger 21 is inserted into the detent bore 17 and the leaf spring 19 is inserted into the detent slot 15 over detent plunger 21, the leaf spring 19 has physical contact with the detent plunger 21, but is not physically connected to the detent plunger 21. The leaf spring 19 is subsequently held in the detent slot 15 by the set screw 20. As a result, the set screw 20 is able to hold the leaf spring 19 within the detent slot 15 in place so that the leaf spring 19 is able to flex back and forth in order to accommodate for the movement of the detent plunger 21, when the adjustment screw 10 is manipulated by external forces. More specifically, the detent plunger 21 is designed to engage with the at least one axial groove 14 of the adjustment screw 10 when the detent plunger 21 is placed into the detent bore 17. When the adjustment screw 10 is manipulated by external forces, the detent plunger 21 is slightly pushed out of the detent bore 17, with the leaf spring 19 experiencing bending elastic deformation as a result. This position persists until the detent plunger 21 is once again aligned with the at least one axial groove 14, at which point the elastic deformation of the leaf spring 19 pushes the detent plunger 21 back into the at least one axial groove 14. Thus, the detent plunger 21 is engaged with the at least one axial groove 14 and prevents the adjustment screw 10 from rotating slightly due to impacts or other shock forces the firearm may be exposed to during use. In other words, the component configuration of the adjustment channel 9, the detent slot 15, the adjustment screw 10, and the leaf spring detent 18 allow a user to precisely control and adjust the amount of generated gas rerouted through the adjustable gas block 1.

A benefit of the interaction between the detent plunger 21 and the adjustment screw 10 is the production of audible clicks as the detent plunger 21 is pushed into the at least one axial groove 14 in the adjustment screw 10. These clicks provide an auditory reference for a user, allowing the user to gauge how much of the gas flow channel 8 is being obstructed. This trait of the present invention is useful as users may find themselves needing to adjust the generated gas flow for a variety of reasons. One such example is the addition of a suppressor, which affects the firing characteristics of a weapon, and thus the ideal amount of gas that should be redirected through the adjustable gas block 1. Regardless of the reason, the present invention provides a means for a user to discretely adjust the impedance of gas through the gas flow channel 8, ranging from no impedance to full impedance.

Another benefit of the interaction between the detent plunger 21 and the adjustment screw 10 is maintaining of a precision setting for the rerouted gas of the adjustable gas block 1. The detent plunger 21 prevents the adjustment screw 10 from encountering slight variations in position due to firing of the weapon or movement of a user as the detent plunger 21 engages with the at least one axial groove 14 to secure the adjustment screw 10 in a discrete position. Since the preferred embodiment of the present invention comprises the first groove, the second groove, and the third groove as the at least one axial groove 14, the adjustment screw 10 is completed with 12 discrete positions. More specifically, the adjustment screw 10 is capable of being moved four full turns (each turn being a 360 degree rotation of the screw) resulting in the 12 discrete positions. Although the detent plunger 21 engages with one of the grooves to prevent the adjustment screw 10 from rotating slightly, a user imparted force is sufficient to deform the leaf spring 19 and displace the detent plunger 21 enough to allow the adjustment screw 10 to be switched between discrete positions.

Although the invention has been explained in relation to its preferred embodiment, it is to be understood that many other possible modifications and variations can be made without departing from the spirit and scope of the invention as hereinafter claimed.

What is claimed is:

1. A gas flow volume control apparatus comprises:

an adjustable gas block;

a securing member;

the adjustable gas block comprises a barrel interface surface, a gas-tube channel, a gas flow channel, an adjustment channel, an adjustment screw, a detent slot, and a leaf spring detent;

the adjustable gas block being adjacently connected atop the securing member;

the barrel interface surface being extended from a front surface of the adjustable gas block to a rear surface of the adjustable gas block;

the gas-tube channel traversing into the adjustable gas block from the rear surface;

the gas flow channel traversing from the barrel interface surface to the gas-tube channel;

the gas flow channel being in fluid communication with the gas-tube channel;

the adjustment channel traversing into the gas flow channel from the front surface through the adjustable gas block;

the adjustment channel being in fluid communication with the gas flow channel;

the adjustment screw being engaged within the adjustment channel;

the detent slot traversing into the adjustable gas block from an external surface of the adjustable gas block; and the leaf spring detent being connected to the detent slot and engaged with the adjustment screw.

2. The gas flow volume control apparatus as claimed in claim 1 comprises:

the securing member comprises a connecter base, a first lateral wall, and a second lateral wall;

the connecter base being diametrically opposed of the adjustable gas block;

the first lateral wall being connected in between the connecter base and adjustable gas block;

the second lateral wall being connected in between the connecter base and adjustable gas block, opposite of the first lateral wall; and the barrel interface surface being positioned in between the first lateral wall and the second lateral wall.

3. The gas flow volume control apparatus as claimed in claim 2 comprises:

the connecter base comprises at least one mounting hole and at least one fastener screw;

the at least one mounting hole traversing through the connecter base; and the at least one fastener screw being engaged within the at least one mounting hole.

4. The gas flow volume control apparatus as claimed in claim 1 comprises:

a tube-connecter recess;

the gas-tube channel being offset from the barrel interface surface;

the gas-tube channel being oriented parallel with the barrel interface surface;

the tube-connecter recess traversing through the external surface; and the tube-connecter recess being perpendicularly intersected with the gas-tube channel.

5. The gas flow volume control apparatus as claimed in claim 1, wherein the gas flow channel is perpendicularly oriented with the gas-tube channel.

6. The gas flow volume control apparatus as claimed in claim 1 comprises:

the adjustment channel being positioned in between the barrel interface surface and the gas-tube channel; and the adjustment channel being oriented parallel with the barrel interface surface and the gas-tube channel.

7. The gas flow volume control apparatus as claimed in claim 1 comprises:

the adjustment screw comprises a screw head, a threaded screw body, a flat screw body, and at least one axial groove;

the screw head being concentrically connected with the threaded screw body;

the flat screw body being concentrically connected with the threaded screw body opposite of the screw head; and the at least one axial groove being radially positioned along the threaded screw body.

8. The gas flow volume control apparatus as claimed in claim 7 comprises:

the detent slot comprises a fastener slot and a detent bore;

the leaf spring detent comprises a leaf spring, a set screw, and a detent plunger;

the fastener slot and the detent bore being oppositely positioned of each other across the detent slot;

the fastener slot traversing into the adjustable gas block;

the detent bore traversing into the adjustment channel;

the set screw traversing through the leaf spring, and being securely engaged with the fastener slot;

the detent plunger being concentrically positioned within the detent bore, and engaged with at least one axial groove of the adjustment screw; and he detent plunger being retained within the detent bore through the leaf spring.

* * * * *